United States Patent [19]

Ackerman

[11] Patent Number: 4,806,116

[45] Date of Patent: Feb. 21, 1989

[54] COMBINATION LOCKING AND RADIO FREQUENCY INTERFERENCE SHIELDING SECURITY SYSTEM FOR A COAXIAL CABLE CONNECTOR

[76] Inventor: Abram Ackerman, 179 Fox Hollow Rd., Woodbury, N.Y. 11797

[21] Appl. No.: 177,142

[22] Filed: Apr. 4, 1988

[51] Int. Cl.[4] ..... H01R 13/44

[52] U.S. Cl. ..... 439/304; 439/578

[58] Field of Search ..... 439/304, 578–585

[56] References Cited

U.S. PATENT DOCUMENTS 4,469,386 9/1984 Ackerman ..... 439/304

*Primary Examiner*—Joseph H. McGlynn

*Attorney, Agent, or Firm*—Michael I. Kroll

[57] ABSTRACT

A combination locking and radio frequency interference shielding security system for a coaxial cable connector having a female coaxial plug and a male coaxial plug on a coaxial cable is provided and consists of a head rotatably affixed to the male coaxial plug to engage with the female coaxial plug. The head and the male coaxial plug are retained within a sleeve when the sleeve is pushed over the male coaxial plug and the head, whereby the sleeve is rotatable with respect to the male coaxial plug and the head. A tool is also provided for selectively engaging the head with and disengaging the head from the female coaxial plug. The sleeve is fabricated out of a metal having a relatively high mass to act as a shield for radio frequency interference thus preventing leakage therefrom.

5 Claims, 2 Drawing Sheets

COMBINATION LOCKING AND RADIO FREQUENCY INTERFERENCE SHIELDING SECURITY SYSTEM FOR A COAXIAL CABLE CONNECTOR

BACKGROUND OF THE INVENTION

1. Field of the Invention

The instant invention relates generally to coaxial cable connectors and more specifically it relates to a combination locking and radio frequency interference shielding securing system for a coaxial cable connector and any other type of connector including but not limited to a bayonet or other type of non-threaded connector.

2. Description of the Prior Art

Numerous coaxial cable connectors have been provided in prior art that are adapted to threadably attach a male connector end to a female plug end. While these units may be suitable for the particular purpose of which they address, they would not be as suitable for the purposes of the present invention as heretofore described. Additionally the prior art does not provide for radio frequency interference shielding.

None of the present systems however gives in combination the type of security and radio frequency interference shielding that the instant invention provides in that the prior art easily permits unauthorized disassembly as well as leakage. The integrity of the system is important to many users and accordingly there is a need for an improved tamper proof system combined with shielding.

SUMMARY OF THE INVENTION

A primary objective of the present invention is to provide a combination locking and radio frequency interference shielding security system for a coaxial cable connector that will overcome the shortcomings of the prior art devices.

Another objective is to provide a combination locking and radio frequency interference shielding security system for a coaxial cable connector to secure a connection and render it tamper resistant thus preventing cable signal theft, converter theft, signal leakage, converter tampering and unauthorized second set hook-ups.

An additional objective is to provide a combination locking and radio frequency interference shielding security system for a coaxial cable connector that is operable only by a specially designed tool thus preventing intruders with commonly available tools, such as screwdrivers, wrenches and the like from tampering with the connection.

A further objective is to provide a combination locking and radio frequency interference shielding security system for a coaxial cable connector that is simple and easy to use.

A still further objective is to provide a combination locking and radio frequency interference shielding security system for a coaxial cable connector that is economical in cost to manufacture.

Further objectives of the invention will appear as the description proceeds.

To the accomplishment of the above and related objectives, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENT

Figure 1:
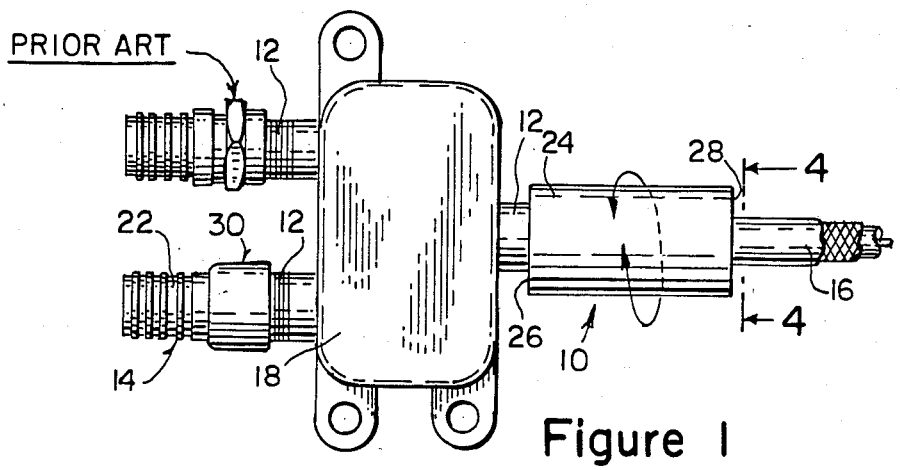
FIG. 1 is an elevational view of the invention secured to an electrical component.
Figure 2:
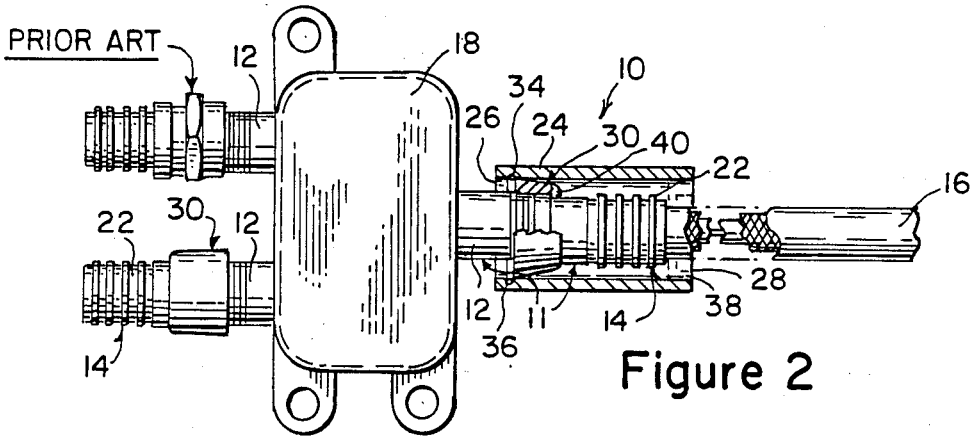
FIG. 2 is an elevational view similar to FIG. 1 with parts broken away and in section.
Figure 3:
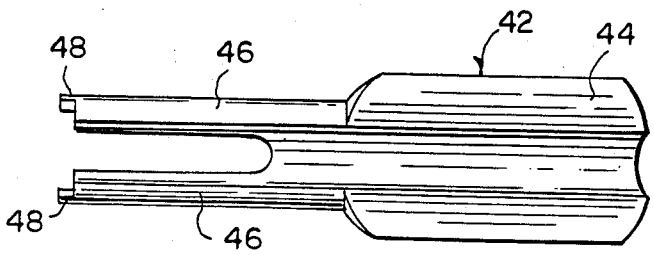
FIG. 3 is an elevational view of the tool used in the invention.
Figure 4:
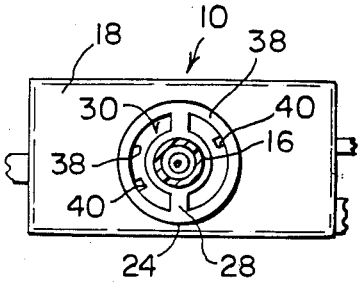
FIG. 4 is a cross sectional view taken along line 4—4 in FIG. 1 with parts broken away.
Figure 5:
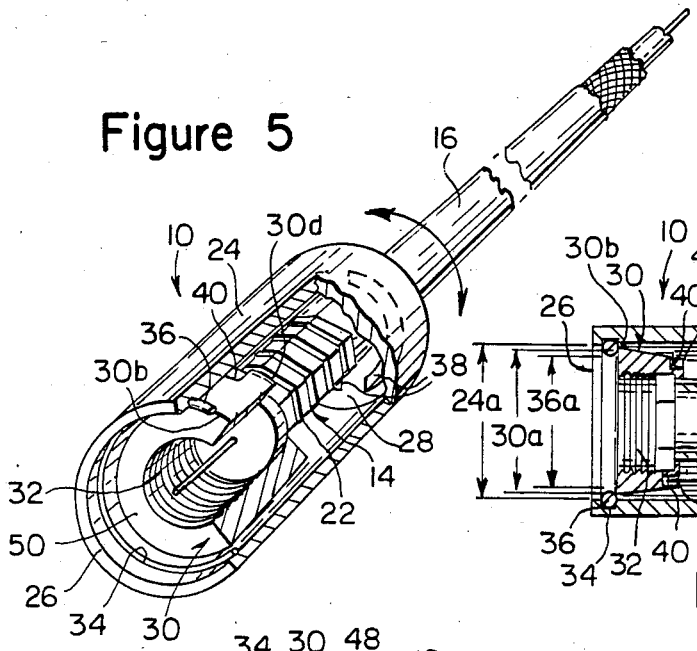
FIG. 5 is a perspective view of the invention with parts broken away.
Figure 6:
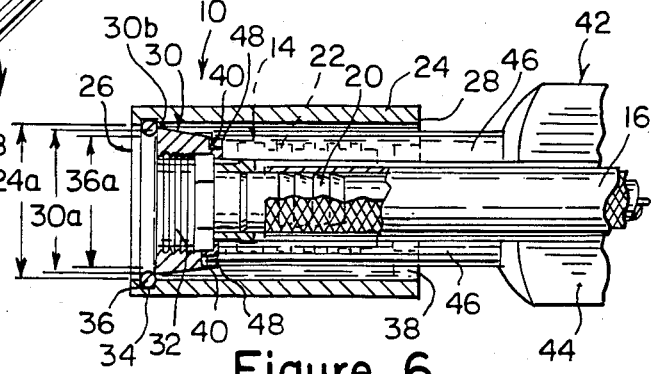
FIG. 6 is an elevational view with parts broken away and in section showing the tool in engagement.
Figure 7:
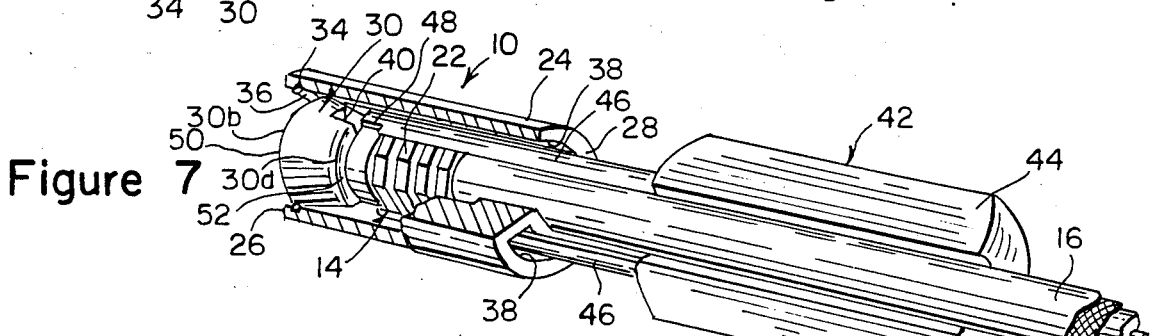
FIG. 7 is a perspective view with parts in section showing the tool almost engaged.
Figure 8:
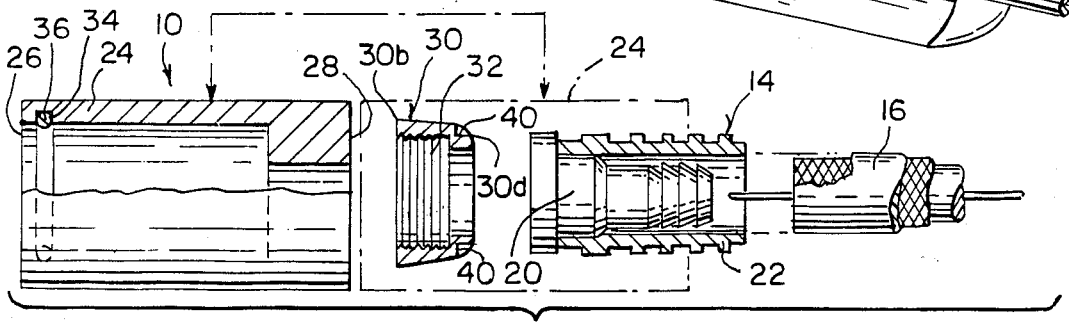
FIG. 8 is an exploded elevational view with parts broken away and in section showing the various parts of the invention.
Figure 9:
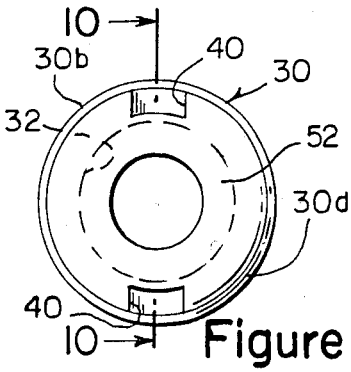
FIG. 9 is an end view of the head.
Figure 10:
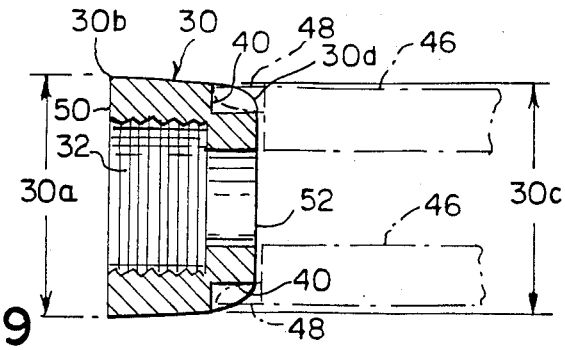
FIG. 10 is a cross sectional view taken along line 10—10 in FIG. 9.

Turning now descriptively to the drawings, in which similar reference characters denote similar elements throughout the several views the figures illustrate a combination locking and radio frequency interference shielding security system 10, for a coaxial cable connector 11 having a female coaxial plug 12 and a male coaxial plug 14 on a coaxial cable 16. The female coaxial plug 12 is part of an electrical component 18 while the male coaxial plug 14 includes an inner mandrel 20 and crimp member 22, attached to an end of the axial cable 16, which are not part of the invention.

The invention consists of a sleeve 24 that has an open forward end 26 and a partially closed rearward end 28. The sleeve 24 is slidably disposed onto the coaxial cable 16. A head 30 that has an internal locking well 32 is rotatably affixed to the male coaxial plug 14 so that the well 32 can lockably engage with the female coaxial plug 12. As shown in the drawings the female coaxial plug 12 is threaded and the well 32 is internally threaded. Any other type of connector including but not limited to a bayonet or other type of non-threaded connector can also be utilized with the invention.

The sleeve 24 has an inner annular groove 34 formed near the open forward end 26 thereof. A C-shaped retaining ring 36 is engaged in the groove 34 for retaining the head 30 and the male coaxial plug 14 within the sleeve 24, when the sleeve 24 is pushed over the male coaxial plug 14 and the head 30. The sleeve 24 is rotatable with respect to the male coaxial plug 14 and the head 30 when the male coaxial plug 14 and the head 30 are so retained within the sleeve 24.

The sleever 24 has two spaced apart slots 38 at the partially closed rearward end 28 while the head 30 has two spaced apart notches 40 extending rearwardly. A tool 42 is provided and has a slotted handle 44 and two spaced apart fingers 46. Each of the fingers 46 has a prong 48 thereon. The slotted handle 44 can fit over and onto the coaxial cable 16 allowing the fingers 46 to pass through the slots 38 so that the prongs 48 can engage with the notches 40. The tool 42 can be rotated to turn the head 30 within the sleeve 24, for selectively engaging the head 30 with and disengaging the head 30 from the female coaxial plug 12 when the head 30 and the male coaxial plug 14 are retained within the sleeve 24.

The head 30 is frusto-conical in shape with its forward end 50 having a wide diameter 30*a* and a sharp corner 30*b* while its rearward end 52 has a narrow diameter 30*c* and a curved corner 30*d*. The sleeve 24 has an inner diameter 24*a* which is larger than inner diameter 36*a* of the C-shaped retaining ring 36, while the inner diameter 36*a* is smaller than the wide diameter 30*a* of the head 30. When the sleeve 24 is pushed over the male coaxial plug 14 and the head 30, the C-shaped retaining ring 36 will slide over the curved corner 30d of the head 30, so that the inner diameter 36*a* will expand. When the C-shaped retaining ring 36 passes the sharp corner 30*b* of the head 30, the inner diameter 34*a* will contract to permanently retain the head 30 and the male coaxial plug 14 within the sleeve 24.

The sleeve 24 is fabricated out of a metal having a relatively high mass to act as a shield for radio frequency interference thus preventing leakage therefrom.

LIST OF REFERENCE NUMBERS

10: locking and radio frequency interference shielding security system
11: coaxial cable connector
12: female coaxial plug
14: male coaxial plug
16: coaxial cable
18: electrical component
20: inner mandrel
22: crimp member
24: sleeve
24a: inner diameter of the sleeve
26: open forward end
28: partially closed rearward end
30: head
30a: wide diameter
30b: sharp corner
30c: narrow diameter
30d: curved corner
32: internal locking well
34: inner annular groove
36: C-shaped retaining ring
36a: inner diameter of the C-shaped retaining ring
38: two spaced apart slots
40: two spaced apart notches
42: tool
44: slotted handle
46: two spaced apart fingers
48: two prongs
50: forward end
52: rearward end.

It will be understood that each of the elements described above, or two or more together, may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A combination locking and radio frequency interference shielding security system for a coaxial cable connector of the type having a female coaxial plug and a male coaxial plug on a coaxial cable, said system comprising:

(a) a sleeve having an open forward end and a partially covered rearward end, said sleeve sideably disposed onto the coaxial cable;

(b) a head having an internal locking well, said head rotatably affixed to the male coaxial plug so that said well can lockably engage with the female coaxial plug;

(c) means for retaining said head and the male coaxial plug with said sleeve, when said sleeve is pushed over the male coaxial plug and said head whereby said sleeve is rotatable with respect to the male coaxial plug and said head when the male coaxial plug and said head are so retained within said sleeve; and (d) means for selectively engaging said head with and disengaging said head from the female coaxial plug when said head and the male coaxial plug are retained within said sleeve.

2. A combination locking and radio frequency interference shielding security system as recited in claim 1, wherein said retaining means includes:

(a) said sleeve having an inner annular groove formed near said open forward end thereof; and (b) a C-shaped retaining ring engaged in said groove.

3. A combination locking and radio frequency interference shielding security system as recited in claim 2, wherein said selectively engaging and disengaging means includes:

(a) said sleeve having two spaced apart slots at said partially closed rearward end;

(b) said head having two spaced apart notches extending rearwardly; and (c) a tool having a slotted handle and two spaced apart fingers, each of said fingers having a prong thereon so that said slotted handle can fit over and onto the coaxial cable allowing said fingers to pass through said slots so that said prongs can engage with said notches, thus said tool can be rotated to turn said head within said sleeve.

4. A combination locking and radio frequency interference shielding security system as recited in claim 3, further comprising:

(a) said head being frusto-conical in shape with forward end having a wide diameter and a sharp corner while rearward end having a narrow diameter and a curved corner; and (b) said sleeve having an inner diameter which is larger than inner diameter of said C-shaped retaining ring, while said inner diameter of said C-shaped retaining ring is smaller than said wider diameter of said head, whereby when said sleeve is pushed over the male coaxial plug and said head, said C-shaped retaining ring will slide over said curved corner of said head, so that said inner diameter of said C-shaped retaining ring will expand and when said C-shaped retaining ring passes said sharp corner of said head, said inner diameter of said C-shaped retaining ring will contract to permanently retain said head and the male coaxial plug within said sleeve.

5. A combination locking and radio frequency interference shielding securing system as recited in claim 4, wherein said sleeve is fabricated out of a metal having a relatively high mass to act as a shield for radio frequency interference thus preventing leakage therefrom.

* * * * *